United States Patent [19]

DeLano

[11] 3,984,888

[45] Oct. 12, 1976

[54] ADJUSTABLE FLOATING CHAIR

[75] Inventor: Arthur D. DeLano, Battle Creek, Mich.

[73] Assignee: D & J Products, Battle Creek, Mich.

[22] Filed: May 21, 1975

[21] Appl. No.: 579,431

[52] U.S. Cl. ..... 9/347; 297/19; 297/354

[51] Int. Cl.[2] ..... B63C 9/08

[58] Field of Search ..... 9/347, 311, 312, 348, 9/349, 12; 297/354, 366, 371, 320, 19

[56] References Cited

UNITED STATES PATENTS

| | | | |
|---|---|---|---|
| 357,383 | 2/1887 | Hamel | 297/320 |
| 1,002,701 | 9/1911 | Kasztriner | 9/311 |
| 2,803,839 | 8/1957 | Mosley | 9/347 |
| 3,117,327 | 1/1964 | Mathew | 9/347 |

FOREIGN PATENTS OR APPLICATIONS

| | | | |
|---|---|---|---|
| 705,657 | 3/1965 | Canada | 9/347 |

*Primary Examiner*—Trygve M. Blix
*Assistant Examiner*—Charles E. Frankfort
*Attorney, Agent, or Firm*—Fisher, Gerhardt & Groh

[57] ABSTRACT

An adjustable floating lounge chair which may be adjusted by an occupant while the arrangement is floating in the water to support an occupant in various positions between an upright seated position and a fully reclining position in which the seat is supported in the water by members of a buoyant material of beaded foam disposed at the sides and at the backrest of the chair.

8 Claims, 4 Drawing Figures

ADJUSTABLE FLOATING CHAIR

This invention relates to a floating lounge chair for use by bathers and swimmers and particularly to such lounge chairs which are adjustable to accommodate different positions of an occupant.

Floating lounge chairs have been provided in which the back and seat portion are angularly fixed relative to each other to form a rigid seat structure. However, it is desirable that lounge chairs be adjustable to provide various angular positions of the seat and backrest portion and also to provide for adjusting the backrest member relative to the seat to form a cot or lounge on which an occupant may recline. Moreover, it is desirable that all of such adjusted positions can be accomplished conveniently by an occupant of the chair during the time that it is floating and so that the occupant's head is supported safely above water level for all positions of adjustment.

It is an object of the invention to provide a floating lounge chair for use by bathers or swimmers which can be converted during its use in the water from a chair in which the occupant sits to a lounge or cot on which the occupant can recline during the time that the lounge chair is floating in the water.

It is another object of the invention to provide a floating lounge chair which is adjustable by an occupant of the lounge chair between positions accommodating sitting and reclining.

Still another object of the invention is to provide a floating lounge chair in which the backrest of the chair portion is provided with buoyant means to aid in supporting an occupant when the latter occupies a reclining position.

A floating or buoyant lounge chair is provided in which float members support an adjustable lounge chair in such a manner that an occupant may float in either a seated or reclining position or in positions intermediate the two positions. The float members support a seat portion which has pivoted thereto a backrest member which may be adjusted to selected angular positions and in all of its selected positions, the backrest is supported to maintain the occupant's head above water lever.

Figure 1:
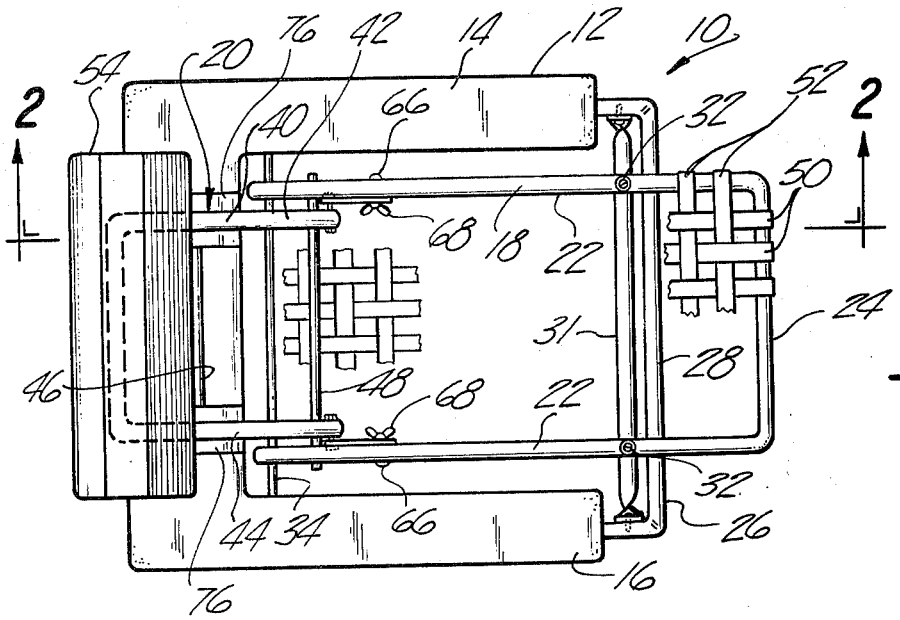
FIG. 1 is a top elevation showing the adjustable and floating lounge chair embodying the invention.

Referring to the drawings and particularly FIG. 1, a floating lounge chair embodying the invention is generally designated at 10. The lounge chair 10 includes a generally U-shaped floatation assembly 12 which includes a pair of side float portions 14 and 16. Preferably the float structure 12 is made of low density material such as rigid beaded foam material made for expanded polystyrene, polyethelene or urethane resins. Such a member forms a relatively solid float structure 12 which supports the remaining portion of the lounge chair 10.

Figure 2:
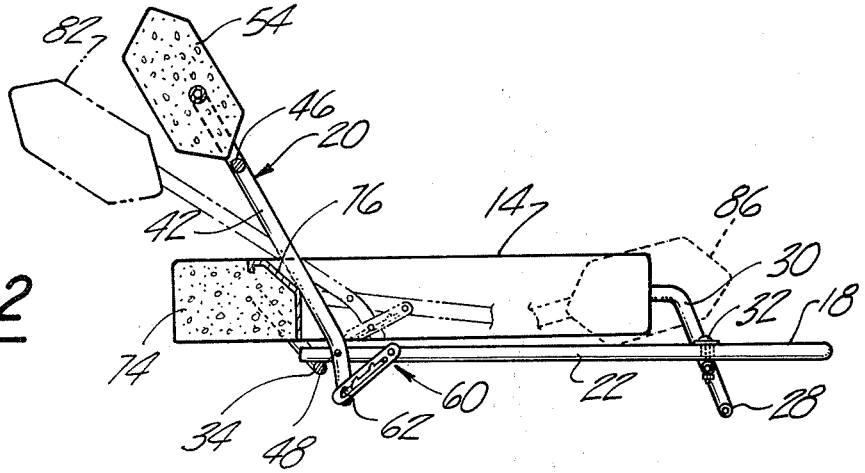
FIG. 2 is a sectional view taken on 2—2 in FIG. 1.

The lounge chair 10 includes a seat member 18 and a backrest member 20. The seat member 18 is formed of tubular material such as aluminum or the like, and is generally U-shaped in configuration having parallel spaced side members 22 with its closed end portion 24 forming the forward edge of the seat member and maintaining the side members 22 spaced apart from each other an amount less than the spacing between the float portions 14 and 16 of the float structure 12. The seat member 18 is supported relative to the float structure 12 in a position slightly below the level of the float member 12 when the latter is in a floating position as shown in FIG. 2. The seat member 18 is attached to a forward support member 26. The support member 26 has a transversely extending portion 28, the opposite ends of which are bent upwardly and then horizontally to form portions 30, the ends of which may be embedded in the float structure 12 or otherwise connected thereto. A transverse crossbar 31 is connected at its opposite ends to the frame portions 30 in slightly elevated relation to the transverse portion 28 and the seat member 18 is attached to the crossbar 31 by means of bolts 32 loosely fitted to permit limited pivotal movement of the seat member 18 relative to the bar 31.

The end of the seat member 18 opposite the form edge 24 is supported relative to the float structure 12 through means of a U-shaped bale element 34 which depends downwardly from the float structure 12 and is connected to the latter in any conventional manner such as by being embedded in the float material. As best seen in FIG. 2, the seat member 18 has the rearward end portion of the side frame members 22 resting on top of the bale 24 which acts as a support. In this manner the seat member 18 is supported generally parallel to and below the float structure 12.

The backrest member 20, as best seen in FIG. 1, includes a U-shaped frame 40 which may be made of tubular aluminum to form a pair of parallel side members 42 and 44. The side members 42 and 44 are also joined together by a crossbar 46 and the lower ends are held in spaced apart relationship by a rod 48. The rod 48 passes through the side members 42 and 44 with the projecting ends pivotally received in openings in the side members 22 of the seat portion 18. This latter arrangement permits the backrest member 20 to be pivoted about the axis of the rod 48 relative to the seat member 18. The rod 48 also acts as a guide for longitudinally extending webbing 50 which extends longitudinally of the seat member 18 and backrest member 28 and has its opposite ends connected to the forward frame portion 24 of the seat and the crossbar 46 of the backrest 20. Other webbing 52 extends transversely of the seat and backrest members and is interwoven with the longitudinal strips to form body supporting portions.

The backrest member 20 also includes a buoyant member 54 which is formed on the closed end of the U-frame 40 above the crossbar 46. The buoyant member 54 acts as a headrest at the upper end of the backrest member 20 when the structure is used as a chair as seen in FIG. 2 and also forms a buoyant or float portion when the backrest member 20 is adjusted to be immersed in the water as seen in FIG. 3.

The side members 42 and 44 of the backrest 20 are spaced apart a distance slightly less than the spacing of the side members 22 of the seat member as best seen in FIG. 1, and lower ends project below the pivot rod 48. The depending ends of the side frame members 42 and 44 are pivotally connected to a pair of slide brackets 60 by means of pivot bolts 62 passing through the lower ends of the side frame members 42 and 44 and slots 64 extending longitudinally of each of the slide bracket 60. The pivot bolts 62 form a connection which is free to slide in the slots 64. The opposite ends of the bracket members 60 are pivotally connected to the side members 22 of the seat member 18 by means of bolts 66 and wing nuts 68. The bolts 66 pass through the side members 22 and through openings 70 in the slide brackets 60 to permit free pivoting movement.

Figure 4:
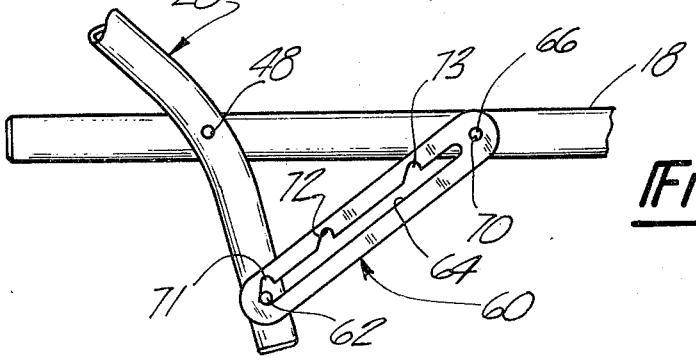
FIG. 4 is a view at an enlarged scale showing bracket elements for holding portions of the lounge chair in selected adjusted positions.

As seen in FIG. 4, showing one of the brackets 60, the slot 64 in the slide bracket 60 is provided with notches 71, 72 and 73 which are engageable with the pivot pin 62 to determine the selected angular position of the backrest 20 relative to the seat member 18. It will be understood that additional notches may be provided to provide additional angular positions of adjustment.

Figure 3:
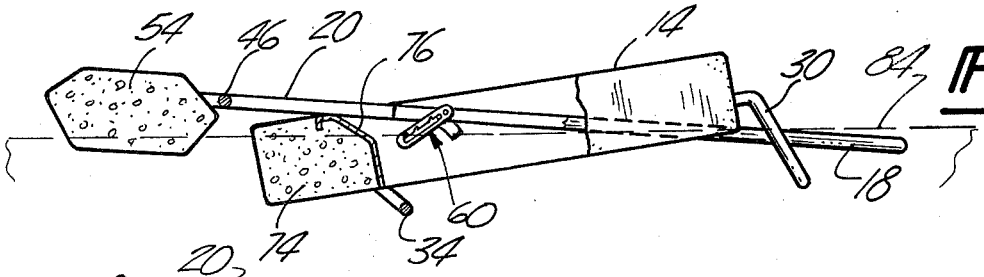
FIG. 3 is a view similar to FIG. 1, but showing an adjusted position of the lounge chair which would accommodate a reclining occupant.

Referring now to FIGS. 1 through 3, the U-shaped float structure 12 includes a transverse buoyant portion 74 which connects the ends of the float member 14 and 16 together and may be made integrally therewith of a beaded foam plastic material. The transverse member 74 is provided with a pair of slide portions 76 which are formed of a durable material such as sheet aluminum or the like and are disposed on the upper surface of the transverse member 74 in alignment with the side members 42 and 44 of the backrest structure 20. The slide members 76 act as bearing and wear surfaces which protect the transverse float portion 74 from damage during relative movement of the float portion 74 and backrest 20 and also to support the backrest in its various positions of adjustment.

The lounge chair 10 is shown in a seating position in FIG. 2 in which the seat member 18 is supported at both a forward and rearward end by the support 26 and bale 34 respectively, and the back member 20 is held in a selected angular position by the bracket slide members 54 so that the back member 20 rests against the slide members 76 and transverse member 74. When the lounge chair is in this adjusted position and is floating in the water, the seat portion 18 is immersed below water level and an occupant of the chair may be seated therein partially imersed in water with the head at a safe elevation above water level and if desired against the headrest formed by the buoyant member 54.

When an occupant of the chair is seated with the chair in the position shown in FIG. 2, and desires to adjust the chair to a reclining position, the adjustment may be accomplished while the chair is floating in the water. To do this, the occupant lifts the depending end of both of the slide brackets 60 slightly to release the notches 71 from the pivot pins 62. This permits the backrest 20 to be pivoted about the rod 48 relative to the seat member 18 with the pivot bolts 62 sliding in the slots 64. During such pivoting movement the side frames 42 and 44 of the backrest 20, are guided by the slide portions 76 and the seat member 18 is moved relative to the support rod 31. When the pivot bolt 62 reaches and is seated in the notches 72, the backrest 20 assumes the position shown in broken lines indicated at 82 so that an occupant can comfortably assume a partially reclining position. Upon release of the pivot bolts 62 from the notches 72, the backrest 20 may be pivoted until the backrest 20 and seat member 18 are generally horizontal and in alignment with each other at which time the pivot bolts 62 will be at the end of slots 64. With an occupant in the lounge chair 10 reclining on the backrest 20 and seat member 18, the unit will occupy the position shown generally in FIG. 3 with the buoyant or floatation member 54 partially immersed below the surface of the water indicated at 84 to assist in supporting the reclining occupant and to insure that the occupant's head is maintained above water level.

To return the backrest member 20 to an angular position relative to the seat 18, the reverse procedure is utilized. In other words, the occupant simply moves the backrest 20 so that it pivots relative to the seat member during which time the pivot pins 62 will slide in the slots 64. When the backrest 20 reaches its selected position, the slide brackets 60 will drop by gravity to engage the pin 62 and hold the backrest 20 in the selected angular position.

When the floating lounge chair 10 is removed from the water it may be put in condition for storage or shipment by removing the bolts 66 and wing nuts 68 and allowing the backrest 20 to be pivoted in a clockwise direction against the seat portion 18 to the position in FIG. 2 indicated in broken lines at 86.

An adjustable and floating lounge chair has been provided in which an occupant of the lounge chair can be supported in the water in a seated position in which the occupant's head is located well above the water level and in which the occupant himself may adjust the lounge chair while it is floating so that he may occupy a reclining position. In the reclining position, a member which formerly provided a headrest for the seated occupant, becomes immersed in the water to form a floatation member which supports the occupant in a reclining position and still maintains his head well above the water level. The seat affords various angular positions of the backrest member relative to the seat portion and such adjustments may be readily made by an occupant of the lounge chair while it is floating in the water.

The embodiments of the invention in which an exclusive property or privilege is claimed are defined as follows:

1. A floating, reclining chair comprising; a pair of parallel spaced float members, a seat member disposed between said float members and being connected thereto for angular movement relative to said float members between a first position in which said seat member is substantially parallel to said float members and a second position in which said seat member is disposed at an angle to said float members, a backrest member pivoted to said seat member for adjustable movement relative thereto between a first position in which the backrest member is at an angle to said seat member when said seat member is in it first position to accommodate a seated occupant, to a second position in which said backrest member is disposed parallel to said seat member and said seat member is at an angle to said float members to accommodate a reclining occupant, bracket means acting between said seat member and backrest member to maintain said members in selected positions relative to each other, and a support member disposed transversely between and connected to said float members and engageable with said backrest member to support the backrest member for all positions between said first and second positions of said backrest member.

2. The combination of claim 1 and further comprising a buoyant member formed on said backrest member to form a headrest when said backrest member is in said first position and to form a supporting buoyant portion when said backrest member is in said second position.

3. The combination of claim 1 in which said support member is made of buoyant material and forms an additional float member.

4. The combination of claim 3 and further comprising slide means formed on said support member and being engageable with said backrest member to support said backrest member in all of its positions.

5. The combination of claim 4 in which said buoyant material is beaded foam and in which said slide means are formed of a durable hard material.

6. A floating lounge chair comprising; a pair of spaced float members, a seat portion connected adjacent a forward end to said float members for movement relative thereto, a backrest member pivoted to said seat member adjacent a rear edge of said seat member for movement of said backrest member between a first position in which it is disposed at an angle to said seat member to form a chair and a second position in which said backrest member is parallel to said seat member to form an occupant supporting reclining position, said backrest member presenting a portion projecting below said seat member, bracket means between said seat member and said portion of said backrest member to hold said backrest member in selected angular positions between said first and second positions relative to said seat member, support means extending between and connected to said float members and engageable with said backrest member for supporting said backrest member in all of its adjusted positions, a support element secured to said float members and being engageable with a rearward portion of said seat member to support said seat member when said backrest member is in said first position, and an additional float member connected to an upper portion of said backrest member for forming a headrest when said backrest member is in its first position and for emersion in the water to support said backrest member when said backrest member is in its said second position.

7. The combination of claim 6 in which said bracket means include a first portion pivoted to said seat member and a second portion slidable relative to said portion of said backrest member to selected positions.

8. The combination of claim 7 in which said first portion is detachable from said seat member fo relative pivotal movement of said backrest member against said seat member for storage.

* * * * *

UNITED STATES PATENT OFFICE

CERTIFICATE OF CORRECTION

Patent No. 3,984,888 Dated October 12, 1976

Inventor(s) Arthur D. DeLano

It is certified that error appears in the above-identified patent and that said Letters Patent are hereby corrected as shown below:

Column 2, line 30, "24" should read --34--.

Column 4, line 50, "it" should read --its--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*